US008608935B2

(12) United States Patent
Vajo et al.

(10) Patent No.: US 8,608,935 B2
(45) Date of Patent: Dec. 17, 2013

(54) APPARATUS AND METHOD FOR SYNTHESIS OF ALANE

(75) Inventors: John J. Vajo, West Hills, CA (US); Ping Liu, Irvine, CA (US)

(73) Assignee: GM Global Technology Operations LLC, Detroit, MI (US)

( * ) Notice: Subject to any disclaimer, the term of this patent is extended or adjusted under 35 U.S.C. 154(b) by 1228 days.

(21) Appl. No.: 11/685,792

(22) Filed: Mar. 14, 2007

(65) Prior Publication Data

US 2010/0252444 A1 Oct. 7, 2010

Related U.S. Application Data

(60) Provisional application No. 60/785,616, filed on Mar. 24, 2006.

(51) Int. Cl.
*C25B 1/00* (2006.01)
*C25B 9/00* (2006.01)
*C25B 15/08* (2006.01)

(52) U.S. Cl.
USPC ..... 205/477; 204/242; 204/277; 205/349; 205/350

(58) Field of Classification Search
USPC ..... 204/242, 277, 477; 205/477, 349, 350
See application file for complete search history.

(56) References Cited

U.S. PATENT DOCUMENTS 3,377,955 A * 4/1968 Hodgson ..... 149/6
5,013,417 A * 5/1991 Judd, Jr. ..... 204/229.7
5,585,999 A 12/1996 De Long et al.
5,620,584 A 4/1997 Reetz et al.
5,686,204 A 11/1997 Bennett et al.
5,882,499 A * 3/1999 Bonnardel et al. ..... 205/396
6,228,338 B1 5/2001 Petrie et al.
6,617,064 B2 9/2003 Petrie et al.
7,347,920 B2 * 3/2008 Wu et al. ..... 204/242
7,648,757 B2 * 1/2010 Rockenfeller et al. ..... 428/375
2001/0038821 A1 11/2001 Petrie et al.
2002/0014416 A1 * 2/2002 Van Weert ..... 204/246
2004/0142215 A1 7/2004 Barbir et al.
2006/0049063 A1 3/2006 Murphy et al.
2006/0102489 A1 * 5/2006 Kelly ..... 204/246

FOREIGN PATENT DOCUMENTS

DE 1141623 12/1962
DE 102005029563 2/2006

OTHER PUBLICATIONS

P. Rittmeyer and U. Wietelmann. "Hydrides." Ullmann's Encyclopedia of Industrial Chemistry. Jun. 15, 2000. Wiley-VCH Verlag GmbH & Co. KGaA. pp. 1-30.*

C.L. Hussey. "Room temperature haloaluminate ionic liquids. Novel solvents for transition metal solution chemistry." Pure & Applied Chemistry. vol. 60, No. 12. pp. 1763-1772. 1988 (no month given).*

J. Wegrzyn, J. Graetz, J. Reilly, and J. Johnson. "Synthesis and properties of aluminum hydride as a hydrogen storage material." May 23, 2005. Presentation from Department of Energy 2005 Hydrogen Program Annual Review.*

(Continued)

*Primary Examiner* — Keith Hendricks
*Assistant Examiner* — Steven A. Friday
(74) *Attorney, Agent, or Firm* — BrooksGroup

(57) ABSTRACT

One embodiment of the invention includes an electrochemical cell and an externally applied electrical potential used to drive a direct synthesis reaction to produce alane.

27 Claims, 2 Drawing Sheets

(56) References Cited

OTHER PUBLICATIONS

International Search Report and Written Opinion for International Application No. PCT/US07/63933 filed Mar. 14, 2007; Applicant: GM Global Technology Operations, Inc.

Tamburello et al., Fundamental Environmental Reactivity Analysis of Hydrogen Storage Materials, Department of Energy Hydrogen Program Annual Progress Report 2010, Feb. 2011. pp. 576-580, United States.

* cited by examiner

APPARATUS AND METHOD FOR SYNTHESIS OF ALANE

CROSS-REFERENCE TO RELATED APPLICATIONS

This application claims the benefit of U.S. Provisional Application No. 60/785,616, filed Mar. 24, 2006.

FIELD OF THE INVENTION

The present invention relates to an apparatus for the synthesis of alane and methods of making the same.

BACKGROUND OF THE INVENTION

Alane (also called aluminum hydride, with the chemical formula $AlH_3$) is a potential source of hydrogen for future fuel cell powered vehicles. Onboard a fuel cell vehicle, alane can be decomposed to give hydrogen. A byproduct of the reaction is aluminum metal. For alane to be widely used in fuel cell vehicles, the aluminum metal must be reprocessed back into alane with high energy-efficiency. Directly reacting aluminum metal and hydrogen gas to produce alane is difficult because the thermodynamics are not favorable.

The synthesis of alane is well developed. Beginning in the 1960's (and continuing today) alane has been considered an attractive rocket propellant. However, thus far there has been no need to directly react aluminum and hydrogen to form alane. Therefore, because directly reacting aluminum and hydrogen is difficult, the prior art synthesis procedures are indirect. For example, the best developed synthesis of alane ($AlH_3$) begins with aluminum chloride ($AlCl_3$) and sodium alanate ($NaAlH_4$). These compounds are reacted in a solvent, such as tetrahydrofuran (THF) according to the reaction $$3NaAlH_4+AlCl_3 \rightarrow 4AlH_3+3NaCl \qquad \text{Reaction 1}$$

which gives alane and the byproduct NaCl. For this synthesis method to be used to reprocess aluminum, the aluminum together with the NaCl generated in Reaction 1, must first be processed into $AlCl_3$ and $NaAlH_4$. These reactions can be carried out by established methods but are energetically very inefficient.

The thermodynamics of alane have also been well studied. These studies indicate that the direct synthesis of alane from aluminum and hydrogen, proceeds according to the reaction $$Al+3/2H_2 \rightarrow AlH_3 \qquad \text{Reaction 2}$$

Using the thermodynamic calculation module in HSC Chemistry for Windows, the standard enthalpy change, $\Delta H°$, for the direct formation of alane from aluminum metal and hydrogen gas according to Reaction 2 is −11.3 kJ/mol-$AlH_3$ or −7.5 kJ/mol-$H_2$. Because $\Delta H°$ is negative, this reaction is exothermic and might be expected to proceed spontaneously. However, because hydrogen gas is being incorporated into a solid phase, the standard entropy change is also negative. From HSC, $\Delta S°$=−194.8 kJ/K-mol-$AlH_3$ or −129.9 kJ/K-mol-$H_2$. Thus, the standard Gibb's free energy change, $\Delta G°$, which is given by $$\Delta G° = \Delta H° - T*\Delta S° \qquad \text{Equation 1}$$

where T is the absolute temperature, is +45.5 kJ/mol-$AlH_3$ or +30.3 kJ/mol-$H_2$ at 20° C. (293 K). Because $\Delta G°$ must be negative for a reaction to proceed, the direct synthesis of alane, according to Reaction 2, does not occur under standard conditions. Reaction 2 can be forced to proceed by increasing the pressure until the loss of entropy is overcome. The positive $\Delta G°$ may be overcome by applying very high pressures on the order of $10^4$ to $10^5$ atmospheres. However, using these high pressures is very energetically inefficient, technologically difficult and not practical. Because of these limitations, direct synthesis at high pressures has not been widely practiced.

There are other problems associated with the synthesis and storage of alane. Alane decomposes in water. Further, alane decomposes at temperatures above approximately 100° C.

SUMMARY OF EXEMPLARY EMBODIMENTS OF THE INVENTION

One embodiment of the invention includes an electrochemical cell and an externally applied electrical potential used to drive a direct synthesis reaction to produce alane.

Other embodiments of the present invention will become apparent from the detailed description provided hereinafter. It should be understood that the detailed description and specific examples, while indicating the exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF EXEMPLARY EMBODIMENTS

Figure 1:
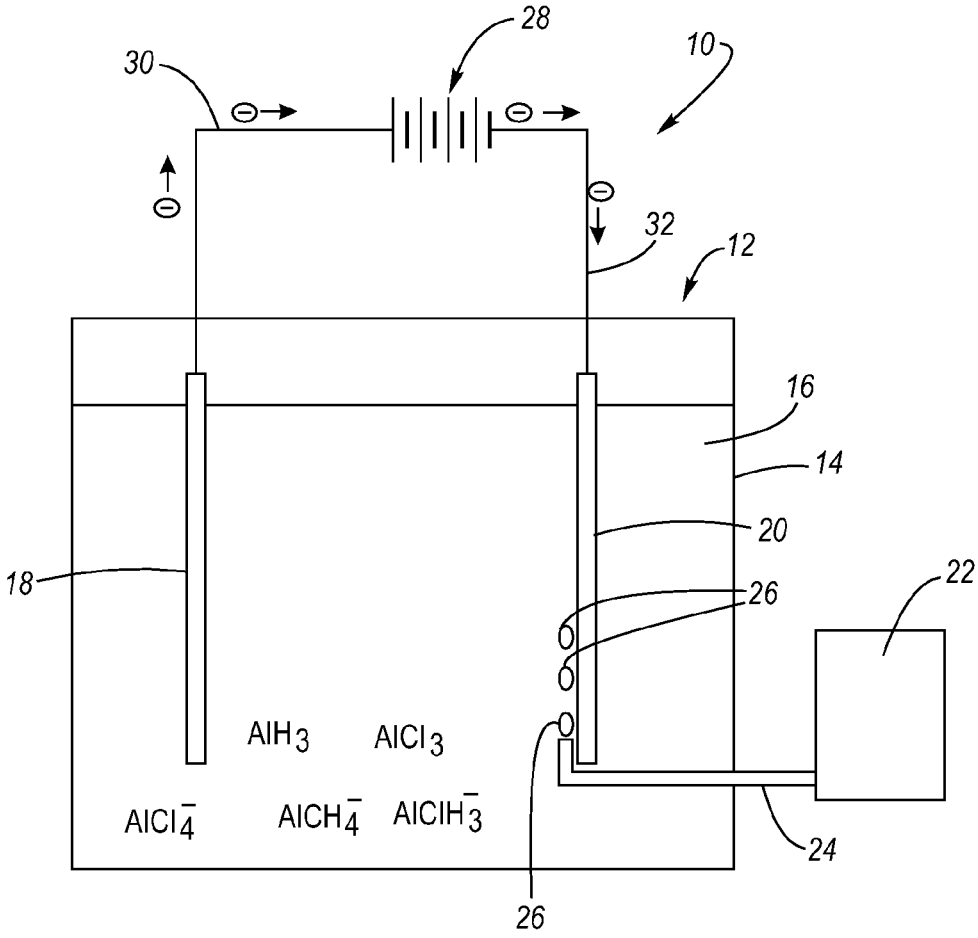
FIG. 1 is a schematic illustration of an apparatus for synthesizing alane according to one embodiment of the invention.

The following description of embodiment(s) is merely exemplary in nature and is in no way intended to limit the invention, its application, or uses.

One embodiment of the invention includes a method for synthesizing alane directly from aluminum metal and hydrogen gas which overcomes the unfavorable thermodynamics. Another embodiment of the invention includes an electrochemical cell and an externally applied electrical potential used to drive the direct synthesis reaction to produce alane. Another embodiment of the invention includes the use of ionic liquids that enable the electrochemical cell to be operated at room temperature (or near room temperature).

The direct synthesis of alane enables aluminum, a byproduct when alane is decomposed to generate hydrogen, to be efficiently reprocessed back into alane. Efficiently reprocessing aluminum into alane, which completes the cycle $AlH_3 \rightarrow Al+3/2H_2 \rightarrow AlH_3$, would enable alane to be a recyclable and, therefore, sustainable hydrogen source for transportation applications.

In one embodiment of the invention, the electrochemical cell includes an ionic liquid, which may be a mixture of an organic chloride salt ($R^+Cl^-$) and aluminum chloride ($AlCl_3$). Examples of embodiments of the organic salt ($R^+Cl^-$) include 1-(1-butyl)pyridinum chloride (BPC) or 1-methyl-3-ethylimidazolium chloride (MEIM). In alternative embodiments of the invention, the $AlCl_3$ may be present in molar amounts from 0 to 1, from 0.2 to 0.9, or from 0.35 to 0.65. The amount of $AlCl_3$ determines the melting point. For example, for MEIC-$AlCl_3$ mixtures, compositions between 0.2 and 0.7 molar have melting points below 50° C. and compositions between approximately 0.35 and 0.65 molar are liquid at room temperature.

In one embodiment of the invention, the ionic liquid includes anions (the negative ions) are chloroaluminates, for example $AlCl_4^-$. The chemical similarity of $AlCl_4^-$ with alane ($AlH_3$) and possible reaction intermediates in the direct synthesis reaction, such as $AlH_4^-$ and $AlCl_3H^-$, suggests that the direct synthesis can occur in an ionic liquid-based electrochemical cell. The ionic liquid may also include at least one of hydridoaluminate anions or haloaluminate anions.

The molar composition of $AlCl_3$ also controls the Lewis acidity of the liquid. Liquids with molar amounts of $AlCl_3$ below 0.5 are designated as basic and amounts above 0.5 are designated acidic. A composition equal to 0.5 is neutral. The acidity is determined by the anion composition of the liquid. The major anions that occur in $AlCl_3$-based ionic liquids are $Cl^-$, $AlCl_4^-$, and $Al_2Cl_7^-$. The Lewis acid-base reactions are $$Cl^- + AlCl_3 = AlCl_4^- \quad \text{Reaction 3}$$

and $$AlCl_4^- + AlCl_3 = Al_2Cl_7^-. \quad \text{Reaction 4}$$

In one embodiment of the invention the electrochemical cell includes an electrolyte comprised of a nonionic organic solvent such as tetrahydrofuran (THF) together with dissolved aluminum chloride ($AlCl_3$) and lithium chloride (LiCl). The LiCl may be present in concentrations up to approximately 1.5 M (molar), which is the solubility limit of LiCl in THF. The $AlCl_3$ may be present in concentrations of preferably greater than 0.2 M and less than approximately 3 M. Interaction of the LiCl and $AlCl_3$ will lead to the formation of $AlCl_4^-$ anions. The electrolyte could also contain dissolved $LiAlH_4$ in concentrations up to approximately 1 M.

In one embodiment of the invention, the anode of the electrochemical cell includes aluminum. This anode may be formed from the recovered aluminum powder by pressing or other suitable means. As the cell is run, this anode is consumed as the aluminum is converted into alane. Thus, the anode must be periodically, or continuously, replaced.

In one embodiment of the invention, the cathode for the electrochemical cell is constructed from Pt or other suitable inert metal. Other possible cathode metals at least one of Fe, Mo, W, Zn, or Pd or alloys thereof. The cathode functions as a hydride electrode by bubbling hydrogen gas over the metal surface. The hydrogen is consumed to make alane but the cathode metal serves only a catalytic role and is not consumed.

During operation, aluminum is oxidized at the anode according to the overall reactions $$Al + 4Cl^- \rightarrow AlCl_4^- + 3e^- \quad \text{Reaction 5}$$

and $$Al + 7AlCl_4^- \rightarrow 4Al_2Cl_7^- + 3e^-. \quad \text{Reaction 6}$$

At the cathode, hydrogen gas is reduced according to the overall reactions $$\tfrac{1}{2}H_2 + AlCl_4^- + e^- \rightarrow AlCl_3H^- + Cl^- \quad \text{Reaction 7}$$

and $$\tfrac{1}{2}H_2 + Al_2Cl_7^- + e^- \rightarrow AlCl_4^- + AlCl_3H^-. \quad \text{Reaction 8}$$

As aluminum oxidization and hydrogen reduction proceed, increasingly hydrogen rich anions, such as $AlCl_2H_2^-$ and $AlClH_3$, will form either through exchange reactions given by $$2AlCl_3H^- = AlCl_2H_2^- + AlCl_4^- \quad \text{Reaction 9}$$

and $$AlCl_2H_2^- + AlCl_3H^- = AlClH_3^- + AlCl_4^-, \quad \text{Reaction 10}$$

or by reduction into an anion already containing hydrogen.

Similar exchange reactions can occur with $Al_2$-based anions. When the concentration of hydrogen rich anions exceeds the solubility, alane ($AlH_3$) will precipitate through the reverse of a H/Cl exchanged version of Reaction 3 or 4 given by $$AlClH_3^- \rightarrow AlH_3 + Cl^- \quad \text{Reaction 11}$$

and $$Al_2Cl_4H_3^- \rightarrow AlH_3 + AlCl_4^-. \quad \text{Reaction 12}$$

Referring now to FIG. 1, in one embodiment of the invention, an apparatus 10 includes an electrochemical cell 12 including a cell tank 14 with an ionic liquid 16 therein as described above. An anode 18 is provide which may include Al, for example, Al recovered from encapsulate alane that was used to generate hydrogen for fueling a fuel cell vehicle. A cathode 20 is provided which may include a metal as described above. A source of hydrogen gas, such as a compressed hydrogen tank 22 may be provided and plumbed, for example, by line 24 so that hydrogen gas 26 may be bubbled over the face of the cathode 20 to reduce hydrogen as described above. A power source 28 is provided, such as a battery and is connected to the anode 18, for example, by wire 30 to provide electrons to the anode. The power source 28 is also connected to the cathode 20, for example, by wire 32 to collect electrons from the cathode 20.

Figure 2:
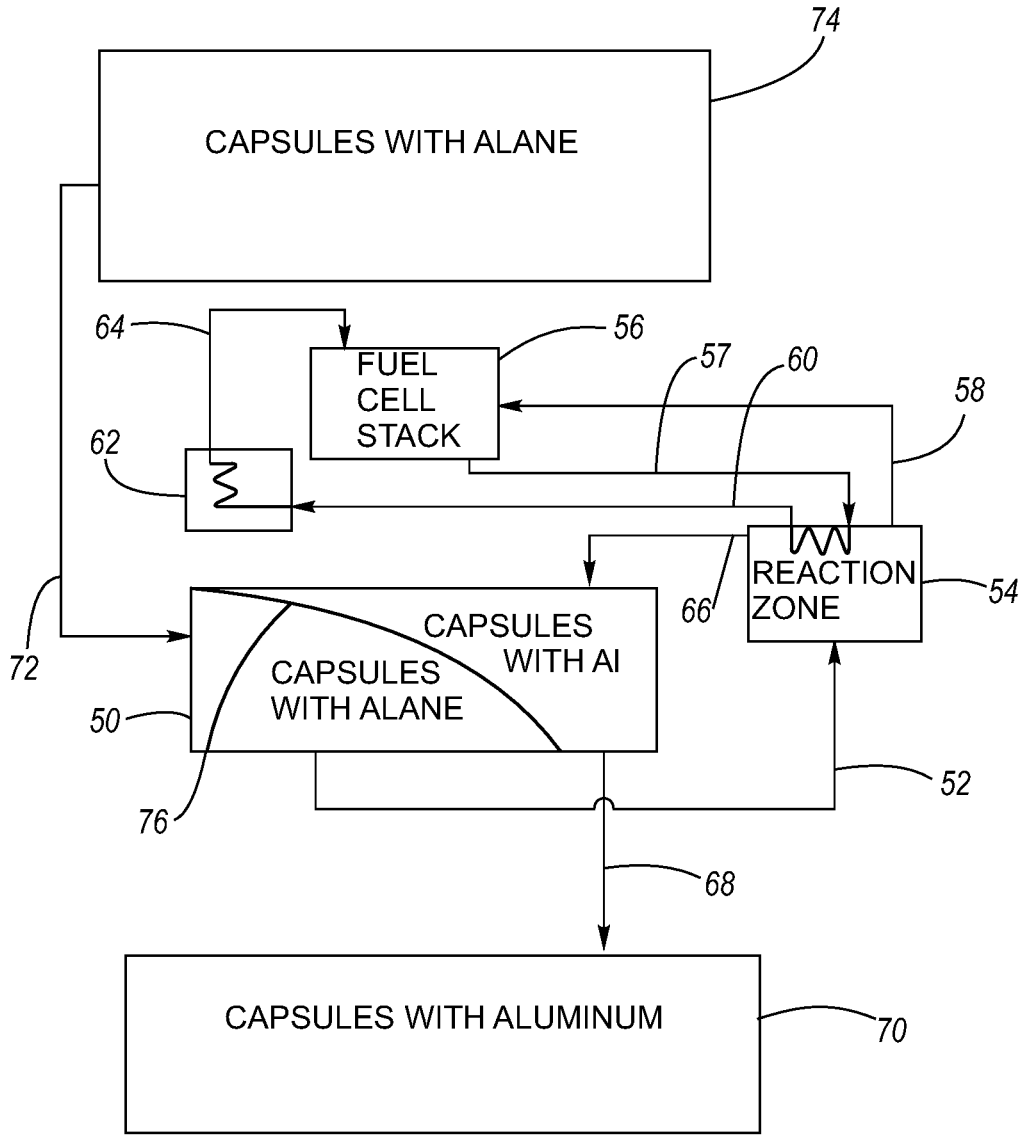
FIG. 2 is a schematic illustration of a method of fueling a fuel cell vehicle with capsules containing alane in a refueling station and operating a fuel cell in the vehicle using the capsules according to one embodiment of the invention.

Referring now to FIG. 2, in one embodiment of the invention, hydrogen is stored onboard a vehicle, such as an automobile, truck, bus or military vehicle, in a lightweight conformable polymer material-based tank 50. Within this tank 50 are capsules including alane ($AlH_3$). These capsules fill space and flow well. The capsules have a polymeric shell with lightly packed alane inside. The shell material is stable to at least 100° C. and very permeable to hydrogen gas. The alane contained in each capsule is processed (particle size and doping/catalysis) to optimize the release of hydrogen, ~10 wt. % with respect to the weight of the alane, at 60-100° C. As needed, a conveyer 52 or other suitable transferring means transports the capsules to a reaction zone, which may be heated by waste heat from the fuel cell. For example, cooling fluid is delivered from the fuel cell 56 by line 57 to the reaction zone which includes a heat exchanger 54 that heats the capsules to release hydrogen. The alane decomposes inside the capsule to aluminum metal and hydrogen gas. The aluminum metal remains in the capsule, which does not break. The hydrogen permeates out of the capsule and flows to anode side of the fuel cell. The released hydrogen is delivered to the fuel cell 56 by line 58. Cooling fluid exits the heat exchanger 54 through line 60 to a coolant holding tank or second heat exchange 62 that removes additional heat from the cooling fluid. The cooling fluid is then delivered by line 64 back to the fuel cell 56 to cool the same. Capsules depleted of hydrogen are returned to the conformable tank 50 by line 66. A bladder 76 or other separation means separates alane containing capsules from used capsules that contain aluminum metal.

During refueling, the used capsules are drained out of the conformable tank 50, by gravity, by line 68 into a tank 70 or tanker truck situated below the vehicle level of the refueling station. New alane capsules are loaded into the conformable tank 50, again by gravity, by line 72 from a tank 72 or tanker truck parked above the vehicle level.

Figure 3:
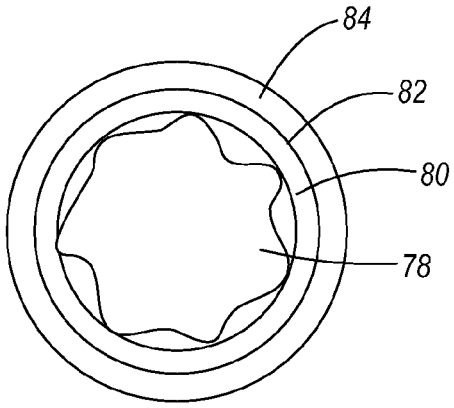
FIG. 3 is a cross section of a capsule including alane according to one embodiment of the invention.

Referring now to FIG. 3, in one embodiment of the invention, the particle of alane 78 are enclosed in polymer shell 80. In one embodiment the shell 80 is tough and not easily broken and thus is not a concern in impact situations. In another embodiment of the invention, the surface 82 of the shell is chemically treated to make the capsule hydrophobic. This treatment reduces the rate of hydrolysis of the alane if the capsules accidentally come in contact with the atmosphere or liquid water. Alternatively, a second porous hydrophobic shell 84 is formed over the polymer shell 80.

When full of used capsules, the tanker truck returns to a reprocessing facility. The first step in reprocessing is separate the shell material from the Al metal, for example, by cutting open the capsules. The shell material is recycled to encapsulate new alane. The aluminum metal is reacted with hydrogen using the electrochemical processing described above. After synthesis, the alane is encapsulated in the (recycled) polymeric shells and delivered to refueling stations using tanker trucks.

There may be several advantages to using alane for hydrogen storage onboard fuel cell vehicles. First, on a material basis, alane may contain 10 weight percent hydrogen which is high compared with most hydrogen storage materials. Second, if the alane is encapsulated in polymeric shells and stored in a conformable light weight tank, the overall hydrogen storage system (as opposed to the alane material alone) may be much more volumetrically and gravimetrically efficient than tanks required to withstand high pressures. Third, alane may be decomposed using the waste heat from the fuel cell. The decomposition reaction may be adjusted by the particular form (crystal structure) of alane used, by the addition of catalysts, and by tailoring the particle size. Releasing hydrogen from alane using the waste heat from the fuel cell means that no addition energy (i.e., active heating) may be needed for the hydrogen storage system. This increases the efficiency of the overall system. Fourth, refueling may be accomplished by physically adding more alane capsules to an empty fuel tank. In contrast to hydrogen storage options that require onboard chemical hydrogenation of a dehydrogenated storage material, simply physically filling a tank can be very fast, does not require high hydrogen pressures, and does not require additional cooling. These differences simplify the refueling system and also improve energy, volumetric, and gravimetric efficiency.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A process for making alane ($AlH_3$) comprising:
providing an electrochemical cell comprising
an anode comprising Al;
a cathode comprising an inert metal;
a power source for an applying an electrical potential to the anode and cathode;
a non-aqueous electrolyte liquid comprising aluminum chloride;
supplying electrons to the cathode;
contacting the cathode with hydrogen gas to reduce the hydrogen and to produce hydride anions in the electrolyte liquid so that alane is precipitated in the liquid forming particles from the alane ($AlH_3$) in the liquid and encapsulating the particles in a hydrogen permeable material comprising a polymer.

2. A process as set from in claim 1 wherein the electrolyte liquid further comprises an organic chloride salt.

3. A process as set forth in claim 2 wherein the organic chloride salt comprises at least one of 1-(1-butyl)pyridinum chloride (BPC) or 1-methyl-3-ethylimidazolium chloride.

4. A process as set forth in claim 1 wherein the electrolyte liquid further comprises at least one of hydridoaluminate anions or haloaluminate anions.

5. A process as set forth in claim 1 wherein the electrochemical cell comprises a tank and wherein the electrolyte liquid is held by the tank, and further comprising, a hydrogen source and a line from the hydrogen source into the tank and positioned to bubble hydrogen gas, from the hydrogen source, over the cathode.

6. A process as set forth in claim 1 wherein the aluminum of the anode comprises aluminum recycled from hydrogen depleted alane from the particles encapsulated in the hydrogen permeable material.

7. A process as set forth in claim 1 wherein the cathode comprises at least one of Pt, Fe, Mo, W, Zn or Pd.

8. A process as set forth in claim 1 wherein the Al is recycled from hydrogen depleted alane;
wherein the metal comprises at least one of Pt, Fe, Mo, W, Zn or Pd;
wherein the power source comprises a battery;
wherein the electrolyte liquid further comprises hydridoaluminate anions and haloaluminate anions;
further comprising a tank and wherein the electrolyte liquid is held by the tank;
further comprising a hydrogen source and a line from the hydrogen source into the tank and positioned to bubble hydrogen gas, from the hydrogen source, over the cathode;
further comprising flowing hydrogen gas from the hydrogen source through the line to bubble hydrogen gas over the cathode to reduce the hydrogen and to produce hydride anions in the electrolyte liquid and so that alane is precipitate in the electrolyte liquid;
and wherein the process is carried out at about room temperature and about atmospheric pressure.

9. A process of making alane ($AlH_3$) comprising:
providing an electrochemical cell comprising:
the anode;
a cathode comprising an inert metal;
a power source;
a non-aqueous electrolyte liquid comprising a nonionic organic solvent, $AlCl_3$ and LiCl;
supplying electrons from the power source to the cathode and the power source receiving electrons from the anode;
wherein the anode comprises aluminum recycled from hydrogen depleted alane ($AlH_3$);
flowing hydrogen gas from a hydrogen source through a line from the hydrogen source into the liquid and bubbling hydrogen over the cathode to reduce the hydrogen and to produce hydride anions in the electrolyte liquid so that alane ($AlH_3$) is precipitated in the liquid.

10. A process as set forth in claim 9 wherein the LiCl is present in a concentration up to about 1.5 molar, and the $AlCl_3$ is present in a concentration of about 0.2 molar to about 3 molar.

11. A process as set from in claim 9 wherein the electrolyte liquid further comprises an organic chloride salt.

12. A process as set forth in claim 11 wherein the organic chloride salt comprises at least one of 1-(1-butyl)pyridinum chloride (BPC) or 1-methyl-3-ethylimidazolium chloride.

13. A process as set forth in claim 9 wherein the electrolyte liquid further comprises haloaluminate anions.

14. A process as set forth in claim 13 wherein the electrolyte liquid further comprises hydridoaluminate anions.

15. A process as set forth in claim 9 wherein the electrolyte liquid further comprises hydridoaluminate anions.

16. A process as set forth in claim 9 wherein the process further comprises recycling aluminum from hydrogen depleted alane ($AlH_3$) and forming the anode from the recycled aluminum.

17. A process as set forth in claim 9 wherein the anode consists of aluminum.

18. An apparatus for the synthesis of alane ($AlH_3$) comprising:

an electrochemical cell comprising an anode consisting essentially of Al;

a cathode comprising an inert metal;

a power source for an applying an electrical potential to the anode and cathode;

wherein the aluminum of the anode comprises aluminum recycled from hydrogen depleted alane ($AlH_3$);

a non-aqueous electrolyte liquid comprising aluminum chloride; and a hydrogen gas source and a line connected to the hydrogen source and_positioned to bubble hydrogen gas over the cathode.

19. An apparatus as set from in claim 18 wherein the electrolyte liquid further comprises an organic chloride salt.

20. An apparatus as set forth in claim 19 wherein the organic chloride salt comprises at least one of 1-(1-butyl) pyridinum chloride (BPC) or 1-methyl-3-ethylimidazolium chloride.

21. An apparatus as set forth in claim 18 wherein the electrolyte liquid further comprises haloaluminate anions.

22. An apparatus as set forth in claim 21 wherein the electrolyte liquid further comprises hydridoaluminate anions.

23. An apparatus as set forth in claim 18 wherein the electrolyte liquid further comprises hydridoaluminate anions.

24. An apparatus as set forth in claim 18 wherein the electrochemical cell comprises a tank and wherein the electrolyte liquid is held by the tank, and further comprising a line from the hydrogen source into the tank positioned to bubble hydrogen gas, from the hydrogen source, over the cathode.

25. An apparatus as set forth in claim 18 wherein the cathode comprises at least one of Pt, Fe, Mo, W, Zn or Pd.

26. A process as set forth in claim 18 wherein the anode consists of aluminum.

27. A process of using alane ($AlH_3$) comprising:

producing alane ($AlH_3$) using an electrochemical cell;

precipitating and collecting said alane ($AlH_3$);

encapsulating the alane ($AlH_3$) in a hydrogen permeable polymeric shell;

decomposing said alane ($AlH_3$) to release hydrogen for use in a fuel cell;

recapturing the hydrogen depleted aluminum and processing the aluminum into an electrochemical cell anode;

and re-hydrogenating said hydrogen depleted aluminum in an electrochemical cell to produce alane ($AlH_3$).

* * * * *